US011105183B2

(12) United States Patent
Frosell et al.

(10) Patent No.: US 11,105,183 B2
(45) Date of Patent: Aug. 31, 2021

(54) VARIABLE FLOW RESISTANCE SYSTEM FOR USE WITH A SUBTERRANEAN WELL

(71) Applicant: Halliburton Energy Services, Inc., Houston, TX (US)

(72) Inventors: Thomas Jules Frosell, Irving, TX (US); Michael Linley Fripp, Carrollton, TX (US); Zahed Kabir, Garland, TX (US); Zachary Ryan Murphree, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 161 days.

(21) Appl. No.: 16/064,974

(22) PCT Filed: Nov. 18, 2016

(86) PCT No.: PCT/US2016/062707
§ 371 (c)(1),
(2) Date: Jun. 21, 2018

(87) PCT Pub. No.: WO2018/093378
PCT Pub. Date: May 24, 2018

(65) Prior Publication Data

US 2019/0010783 A1 Jan. 10, 2019

(51) Int. Cl.

| | |
|---|---|
| ***E21B 34/08*** | (2006.01) |
| ***E21B 43/12*** | (2006.01) |
| ***E21B 43/08*** | (2006.01) |
| ***E21B 41/00*** | (2006.01) |

(52) U.S. Cl.
CPC ..... *E21B 34/08* (2013.01); *E21B 41/0085* (2013.01); *E21B 43/12* (2013.01); *E21B 43/08* (2013.01)

(58) Field of Classification Search
CPC ..... E21B 34/08; E21B 41/0085
See application file for complete search history.

(56) References Cited

U.S. PATENT DOCUMENTS

| | | | |
|---|---|---|---|
| 5,375,098 | A | 12/1994 | Malone |
| 5,412,568 | A | 5/1995 | Schultz |
| 6,182,764 | B1 | 2/2001 | Vaynshteyn |
| 6,371,210 | B1 | 4/2002 | Bode |
| 7,171,309 | B2 | 1/2007 | Goodman |
| 7,246,660 | B2 | 7/2007 | Fripp |

(Continued)

FOREIGN PATENT DOCUMENTS

| | | | |
|---|---|---|---|
| CN | 201448100 | U1 | 5/2010 |
| CN | 105089572 | B1 | 3/2018 |

(Continued)

OTHER PUBLICATIONS

International Search Report and the Written Opinion for International Application No. PCT/US2016/062707 dated Aug. 4, 2017, 17 pages.

*Primary Examiner* — Robert E Fuller
(74) *Attorney, Agent, or Firm* — Chamberlain Hrdlicka

(57) ABSTRACT

A variable flow resistance system for use with a subterranean well includes a first flow path to receive a fluid, a flow rate sensor to measure a flow rate of the fluid received into the first flow path, and an actuator to control an inflow rate of the fluid received into the first flow path based upon the measured flow rate of the fluid.

17 Claims, 5 Drawing Sheets

(56) References Cited

U.S. PATENT DOCUMENTS

| | | | | |
|---|---|---|---|---|
| 7,673,680 | B2 | 3/2010 | Buyers et al. | |
| 7,983,113 | B2 | 7/2011 | Krueger et al. | |
| 8,033,328 | B2 | 10/2011 | Hall et al. | |
| 8,169,854 | B2 | 5/2012 | Godager | |
| 8,196,678 | B2 | 6/2012 | Jeffryes | |
| 8,319,657 | B2 | 11/2012 | Godager | |
| 8,573,311 | B2 | 11/2013 | Zhao | |
| 8,678,035 | B2 | 3/2014 | Fripp et al. | |
| 8,701,771 | B2 | 4/2014 | Dykstra et al. | |
| 8,752,629 | B2 | 6/2014 | Moen | |
| 9,790,785 | B2 | 10/2017 | Fripp et al. | |
| 9,879,506 | B2 | 1/2018 | Frosell et al. | |
| 2003/0016164 | A1 | 1/2003 | Finke | |
| 2004/0256113 | A1* | 12/2004 | LoGiudice | E21B 34/066 166/381 |
| 2005/0179263 | A1 | 8/2005 | Johansen et al. | |
| 2009/0101329 | A1 | 4/2009 | Clem | |
| 2009/0114396 | A1 | 5/2009 | Kusko et al. | |
| 2011/0180267 | A1 | 7/2011 | Wildman | |
| 2012/0067591 | A1 | 3/2012 | Couturier et al. | |
| 2012/0205122 | A1 | 8/2012 | Peter et al. | |
| 2012/0298370 | A1 | 11/2012 | Xu et al. | |
| 2013/0008648 | A1 | 1/2013 | Lovorn | |
| 2013/0222148 | A1 | 8/2013 | Gano et al. | |
| 2013/0292110 | A1 | 11/2013 | Fraser | |
| 2015/0008037 | A1 | 1/2015 | Mullins et al. | |
| 2015/0021015 | A1* | 1/2015 | Xiao | E21B 43/12 166/250.01 |
| 2015/0337652 | A1 | 11/2015 | Rodney | |
| 2016/0305216 | A1 | 10/2016 | Fripp et al. | |
| 2017/0009574 | A1 | 1/2017 | Murphree et al. | |
| 2017/0159405 | A1* | 6/2017 | Hazel | E21B 33/1277 |
| 2017/0211370 | A1* | 7/2017 | Blange | E21B 47/12 |

FOREIGN PATENT DOCUMENTS

| | | | |
|---|---|---|---|
| EP | 2708858 | A1 | 3/2014 |
| GB | 2522272 | A | 7/2015 |
| WO | 0131167 | A8 | 10/2001 |
| WO | 2006085870 | A1 | 8/2006 |
| WO | 2012100259 | A2 | 7/2012 |
| WO | 2016141456 | A1 | 9/2016 |

* cited by examiner

VARIABLE FLOW RESISTANCE SYSTEM FOR USE WITH A SUBTERRANEAN WELL

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

This disclosure relates generally to equipment utilized and operations performed in conjunction with a subterranean well and, in an example described below, more particularly provides a selectively variable flow restrictor.

In a hydrocarbon production well, it is many times beneficial to be able to regulate flow of fluids from an earth formation into a wellbore, from the wellbore into the formation, and within the wellbore. A variety of purposes may be served by such regulation, including prevention of water or gas coning, minimizing sand production, minimizing water and/or gas production, maximizing oil production, balancing production among zones, transmitting signals, etc.

Therefore, it will be appreciated that advancements in the art of variably restricting fluid flow in a well would be desirable in the circumstances mentioned above, and such advancements would also be beneficial in a wide variety of other circumstances.

BRIEF DESCRIPTION OF THE DRAWINGS

Illustrative embodiments of the present disclosure are described in detail below with reference to the attached drawing figures, which are incorporated by reference herein and wherein.

Figure 1:
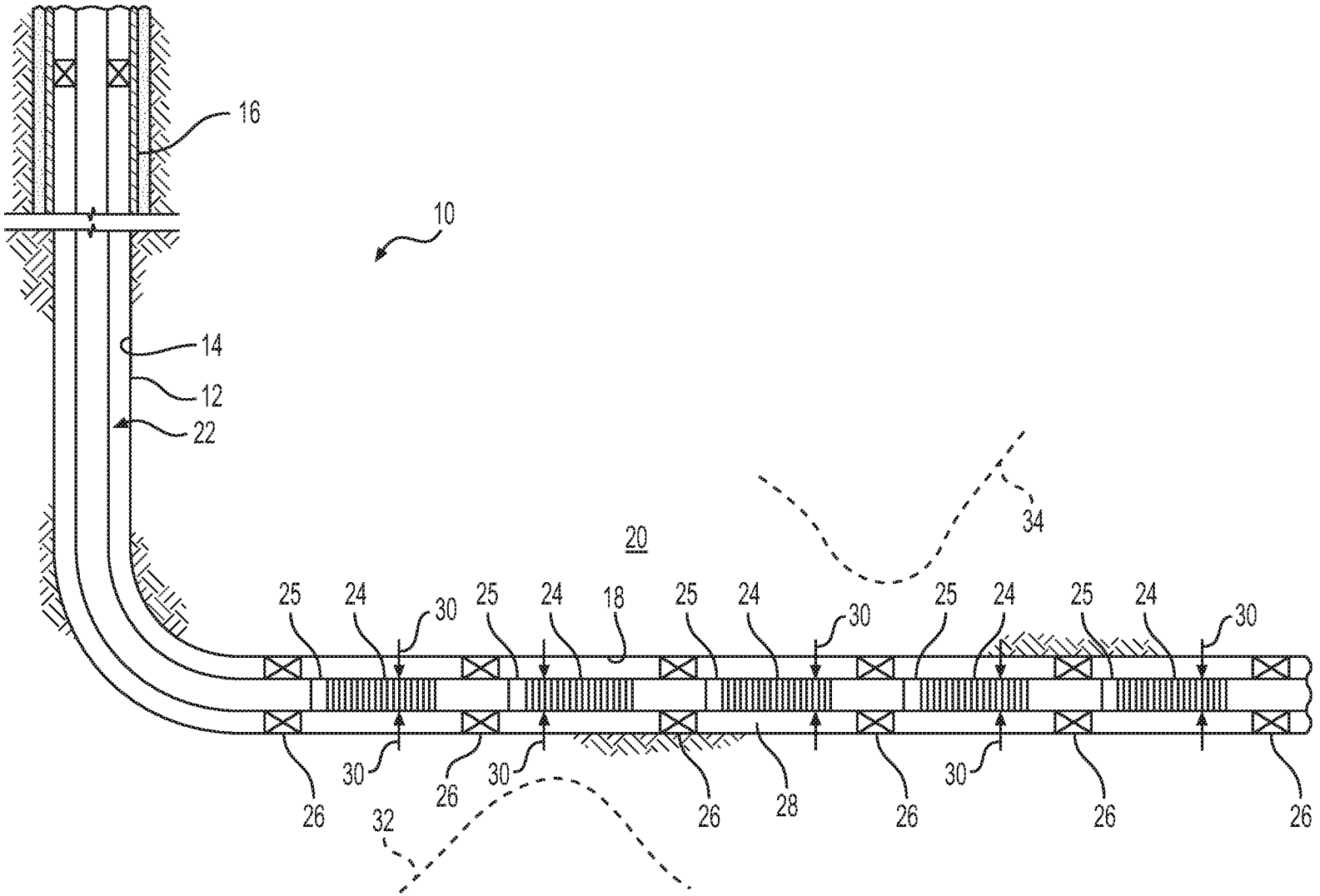
FIG. 1 shows schematic view of a well system including a variable flow resistance system in accordance with one or more embodiments of the present disclosure.

The illustrated figures are only exemplary and are not intended to assert or imply any limitation with regard to the environment, architecture, design, or process in which different embodiments may be implemented.

DETAILED DESCRIPTION OF ILLUSTRATIVE EMBODIMENTS

The following discussion is directed to various embodiments of the present disclosure. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed below may be employed separately or in any suitable combination to produce desired results. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but are the same structure or function.

In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. The use of "top," "bottom," "above," "below," and variations of these terms is made for convenience, but does not require any particular orientation of the components.

Reference throughout this specification to "one embodiment," "an embodiment," or similar language means that a particular feature, structure, or characteristic described in connection with the embodiment may be included in at least one embodiment of the present disclosure. Thus, appearances of the phrases "in one embodiment," "in an embodiment," and similar language throughout this specification may, but do not necessarily, all refer to the same embodiment.

Turning now to the present figures, FIG. 1 shows a well system 10 that can embody principles of the present disclosure. As depicted in FIG. 1, a wellbore 12 has a generally vertical uncased section 14 extending downwardly from casing 16, as well as a generally horizontal uncased section 18 extending through an earth formation 20.

A tubular string 22 (such as a production tubing string) is installed in the wellbore 12. Interconnected in the tubular string 22 are multiple well screens 24, variable flow resistance systems 25, and packers 26. The packers 26 seal off an annulus 28 formed radially between the tubular string 22 and the wellbore section 18. In this manner, fluids 30 may be produced from multiple intervals or zones of the formation 20 via isolated portions of the annulus 28 between adjacent pairs of the packers 26.

Positioned between each adjacent pair of the packers 26, a well screen 24 and a variable flow resistance system 25 are interconnected in the tubular string 22. The well screen 24 filters the fluids 30 flowing into the tubular string 22 from the annulus 28. The variable flow resistance system 25 variably restricts flow of the fluids 30 into the tubular string 22, based on certain characteristics of the fluids.

At this point, it should be noted that the well system 10 is illustrated in the drawings and is described herein as merely one example of a wide variety of well systems in which the principles of this disclosure can be utilized. It should be clearly understood that the principles of this disclosure are not limited at all to any of the details of the well system 10, or components thereof, depicted in the drawings or described herein.

For example, it is not necessary in keeping with the principles of this disclosure for the wellbore 12 to include a generally vertical wellbore section 14 or a generally horizontal wellbore section 18, as a wellbore section may be oriented in any direction, and may be cased or uncased, without departing from the scope of the present disclosure. It is not necessary for fluids 30 to be only produced from the formation 20 as, in other examples, fluids could be injected into a formation, such as injected through the tubular string 22 and out into the formation 20, or fluids could be both injected into and produced from a formation, etc. Further, it is not necessary for one each of the well screen 24 and variable flow resistance system 25 to be positioned between each adjacent pair of the packers 26. It is not necessary for a single variable flow resistance system 25 to be used in conjunction with a single well screen 24. Any number, arrangement and/or combination of these components may be used.

It is not necessary for any variable flow resistance system 25 to be used with a well screen 24. For example, in injection operations, the injected fluid could be flowed through a variable flow resistance system 25, without also flowing through a well screen 24.

It is not necessary for the well screens 24, variable flow resistance systems 25, packers 26 or any other components of the tubular string 22 to be positioned in uncased sections 14, 18 of the wellbore 12. Any section of the wellbore 12 may be cased or uncased, and any portion of the tubular string 22 may be positioned in an uncased or cased section of the wellbore, in keeping with the principles of this disclosure.

It should be clearly understood, therefore, that this disclosure describes how to make and use certain examples, but the principles of the disclosure are not limited to any details of those examples. Instead, those principles can be applied to a variety of other examples using the knowledge obtained from this disclosure.

It will be appreciated by those skilled in the art that it would be beneficial to be able to regulate flow of the fluids 30 into the tubular string 22 from each zone of the formation 20, for example, to prevent water coning 32 or gas coning 34 in the formation. Other uses for flow regulation in a well include, but are not limited to, balancing production from (or injection into) multiple zones, minimizing production or injection of undesired fluids, maximizing production or injection of desired fluids, etc.

Examples of the variable flow resistance systems 25 described more fully below can provide these benefits by increasing resistance to flow if a fluid velocity increases beyond a selected level (e.g., to thereby balance flow among zones, prevent water or gas coning, etc.), or increasing resistance to flow if a fluid viscosity decreases below a selected level (e.g., to thereby restrict flow of an undesired fluid, such as water or gas, in an oil producing well).

Whether a fluid is a desired or an undesired fluid depends on the purpose of the production or injection operation being conducted. For example, if it is desired to produce oil from a well, but not to produce water or gas, then oil is a desired fluid and water and gas are undesired fluids.

Note that, at downhole temperatures and pressures, hydrocarbon gas can actually be completely or partially in liquid phase. Thus, it should be understood that when the term "gas" is used herein, supercritical, liquid and/or gaseous phases are included within the scope of that term.

Figure 2:
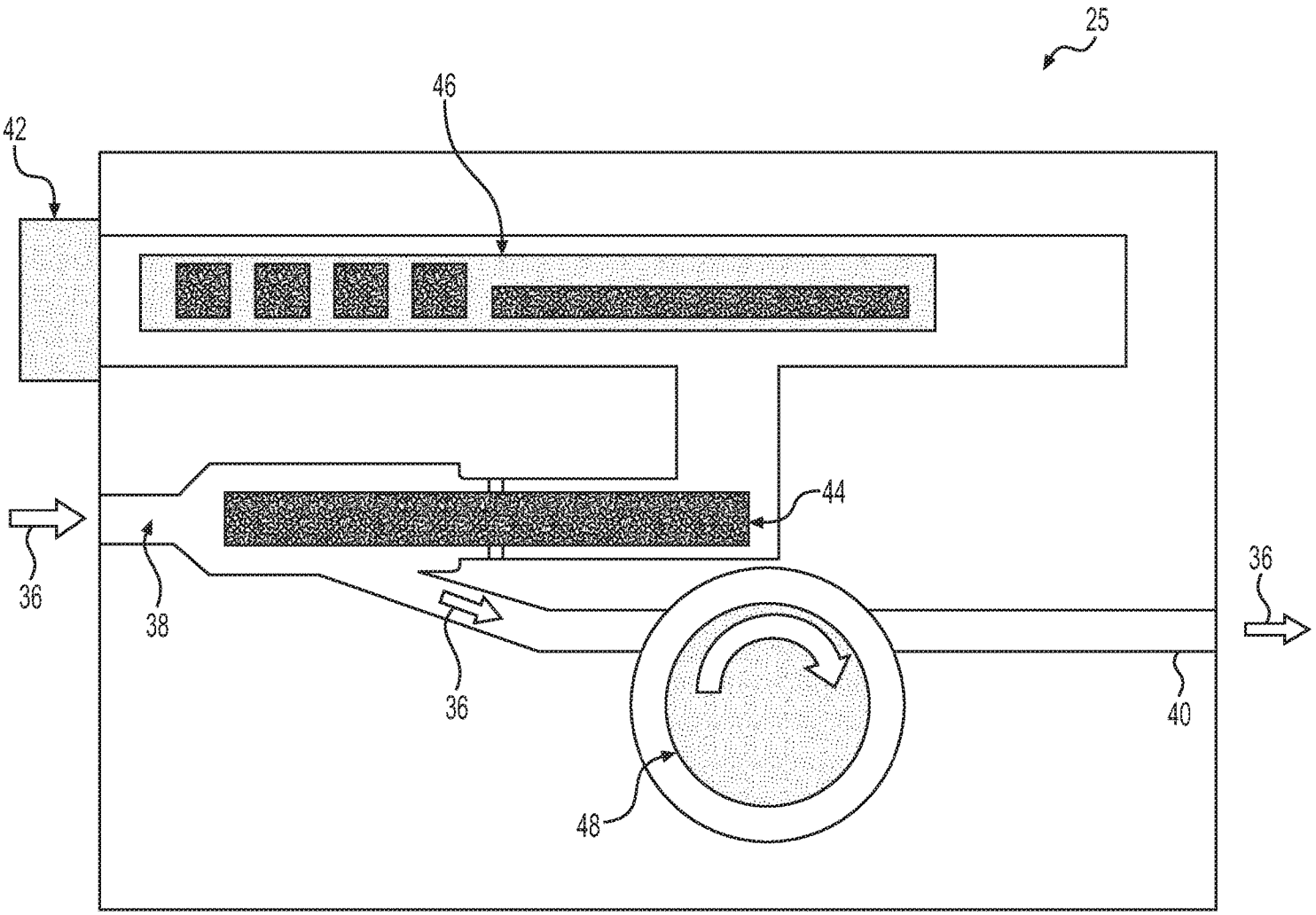
FIG. 2 shows a schematic view of a variable flow resistance system in accordance with one or more embodiments of the present disclosure.

Referring additionally now to FIG. 2, a schematic view of a variable flow resistance system 25 in accordance with one or more embodiments of the present disclosure is shown. In this example, a fluid 36 (which can include one or more fluids, such as oil and water, liquid water and steam, oil and gas, gas and water, oil, water and gas, etc.) may be filtered by a well screen (24 in FIG. 1), and may then flow into a first flow path 38 (e.g., an inlet flow path) of the variable flow resistance system 25. A fluid can include one or more undesired or desired fluids. Both steam and water can be combined in a fluid. As another example, oil, water and/or gas can be combined in a fluid. Flow of the fluid 36 through the variable flow resistance system 25 is resisted to control a flow rate of the fluid flowing through the system 25. The fluid 36 may then be discharged from the variable flow resistance system 25, such as to an interior or exterior of the tubular string 22 via a second flow path 40 (e.g., an outlet flow path). As used herein, the first flow path 38 and the second flow path 40 may be generally described and function as an inlet flow path and an outlet flow path, respectively. However, the present disclosure is not so limited, as the flow of the fluid 36 may be reversed, such as during injection applications, through the variable flow resistance system 25 such that the first flow path 38 and the second flow path 40 may be generally described and function as an outlet flow path and an inlet flow path, respectively.

In other examples, the well screen 24 may not be used in conjunction with the variable flow resistance system 25 (e.g., in injection operations), the fluid 36 could flow in an opposite direction through the various elements of the well system 10 (e.g., in injection operations), a single variable flow resistance system could be used in conjunction with multiple well screens, multiple variable flow resistance systems could be used with one or more well screens, the fluid could be received from or discharged into regions of a well other than an annulus or a tubular string, the fluid could flow through the variable flow resistance system prior to flowing through the well screen, any other components could be interconnected upstream or downstream of the well screen and/or variable flow resistance system, etc. Thus, it will be appreciated that the principles of this disclosure are not limited at all to the details of the example depicted in the figures and described herein. Further, additional components (such as shrouds, shunt tubes, lines, instrumentation, sensors, inflow control devices, etc.) may also be used in accordance with the present disclosure, if desired.

The variable flow resistance system 25 is depicted in simplified form in FIG. 2, but in a preferred example, the system 25 can include various passages and devices for performing various functions, as described more fully below. In addition, the system 25 preferably at least partially extends circumferentially about the tubular string 22, or the system 25 may be formed in a wall of a tubular structure interconnected as part of the tubular string.

In other examples, the system 25 may not extend circumferentially about a tubular string or be formed in a wall of a tubular structure. For example, the system 25 could be formed in a flat structure, etc. The system 25 could be in a separate housing that is attached to the tubular string 22, or it could be oriented so that the axis of the second flow path 40 is parallel to the axis of the tubular string. The system 25 could be on a logging string, production string, drilling string, coiled tubing, or other tubular string or attached to a device that is not tubular in shape. Any orientation or configuration of the system 25 may be used in keeping with the principles of this disclosure.

Referring now back to FIG. 2, the variable flow resistance system 25 includes the first flow path 38 to receive fluid into the system 25 and a second flow path 40 to send fluid out of the system 25. When fluid exits the system 25, the fluid may, for example, enter into the interior of a tool body or out of the exterior of a tool body used in conjunction with the variable flow resistance system 25. The variable flow resistance system 25 may further include a sensor 42 and an actuator 44. The sensor 42 is included to measure one or more properties or characteristics of the fluid received into the system 25, such as measure the flow rate of the fluid received into the system 25. Though not so limited, and as discussed below, the sensor 42 may be positioned near or within the first flow path 38 to measure the property or characteristic of the fluid received into the system 25 through the first flow path 38.

The actuator 44 may control or adjust an inflow rate of fluid received into the system 25 and the first flow path 38. Additionally or alternatively, the actuator 44 may control or adjust the restriction of fluid inflow received into the system 25 and the first flow path 38 and/or control or adjust a drop in pressure between first flow path 38 and second flow path 40. For example, the actuator 44 may be positioned or included within the system 25 to extend into and retract from the fluid flow path extending and formed through the system 25. To increase the inflow rate of the fluid, or decrease the inflow fluid restriction or pressure drop across the system 25, the actuator 44 may retract to enable more fluid to flow through the fluid flow path of the system 25. To decrease the inflow rate of the fluid, or increase the inflow fluid restriction or pressure drop across the system 25, the actuator 44 may extend to restrict the fluid flow through the fluid flow path of the system 25. Further, in one or more embodiments, the actuator 44 may be used to fully stop or inhibit the fluid flow through the fluid flow path of the system 25. For example, if the system 25 is turned or powered off, the actuator 44 may fully extend to prevent fluid flow through the fluid flow path of the system 25. Accordingly, the actuator 44 may be used as or include an adjustable valve to be in a fully open position, a fully closed position, or an intermediate position to control the flow rate of fluid through the system 25. Further, in one or more embodiments, the control or adjustment of the inflow rate of fluid, the restriction of fluid inflow, or the pressure drop may all be parameters related to each other. Accordingly, as used herein, when referring to control or adjustment of one parameter, such as the inflow rate of fluid, may also be referring to control or adjustment of another parameter without departing from the scope of the present disclosure.

The actuator 44 may include a mechanical actuator (e.g., a screw assembly), an electrical actuator (e.g., piezoelectric actuator, electric motor), a hydraulic actuator (e.g., hydraulic cylinder and pump, hydraulic pump), a pneumatic actuator, and/or any other type of actuator known in the art. For example, the actuator 44 may include a linear or axially driven actuator, in which the actuator 44 interacts with an orifice included in the first flow path 38 to operate as an adjustable valve and control the inflow rate of the fluid.

Referring still to FIG. 2, the variable flow resistance system 25 may include one or more power sources. For example, the system 25 may include a power generator 48 and/or a power storage device. The power generator 48 may be used to generate power for the system 25, and the power storage device may be used to provide stored power for the system 25 and/or store power generated by the power generator 48. In one embodiment, the power generator 48 may include a turbine and may be able to generate power from fluid received into the first flow path 38 and flowing through the system 25. The power generator 48 may additionally or alternatively include other types of power generators, such as a flow induced vibration power generator and/or a piezoelectric generator, to generate power from the fluid received into the system 25 and/or from other energy sources present downhole (e.g., temperature and/or pressure sources).

The power storage device may be included within electronics 46 for the system 25 and may be used to provide stored power. In one embodiment, the power storage device may be able to store power generated by the power generator 48 and provide this stored powered for the system 25. The power storage device may include a capacitor (e.g., super capacitor), battery (e.g., rechargeable battery), and/or any other type of power storage device known in the art. In one or more embodiments, as the sensor(s) and/or actuator(s) of the system 25 may require more power than generated by the power generator 48, the power storage device may be used to store power, and then supplement the power generator 48 when running the sensor(s), actuator(s), and/or other components of the system 25.

As discussed above, the system 25, and more particularly the actuator 44, may be used to control or adjust an inflow rate of fluid received into the system 25 through the first flow path 38, control or adjust the restriction of fluid inflow received into the system 25, and/or control or adjust a drop in pressure across the system 25. The inflow rate of the fluid received into the system 25 may be controlled based upon a control signal received by the system 25. A control signal may be sent to the system 25 from a transmitter, such as a transmitter uphole or upstream of the system 25, or even on or close to the surface of the well. The control signal may be sent to the system 25 through the flow rate of the fluid, and more particularly by selectively fluctuating and varying the flow rate of the fluid received by the system 25. A profile or pattern of flow rate fluctuations may be used to indicate a unique control signal, such as with communications involving flow rate telemetry. Accordingly, a transmitter, controlling the flow rate of the fluid, may be able to encode one or more control signals through flow rate fluctuations of the fluid, and a receiver, measuring the flow rate of the fluid, may be able to decode one or more controls signals through the flow rate fluctuations of the fluid.

The transmitter is able to transmit a control signal by generating flow rate fluctuations of the fluid uphole or downstream of the system 25. Accordingly, to generate the flow rate fluctuations, the transmitter may include or control a choke, a bypass around a choke, a valve, a pump, or control the backpressure of the fluid at the surface, thereby selectively generating fluctuations in the flow rate of the fluid into and out of the system 25.

The receiver may be able to receive a control signal by measuring flow rate fluctuations of the fluid at the system 25. The receiver may include or be coupled to a flow rate sensor or flow meter that is able to measure a flow rate of the fluid received into the system 25. For example, with respect to FIG. 2, the sensor 42 may be used to measure the flow rate of the fluid received into the flow path 38. An example of a flow rate sensor 42 may include an accelerometer or a hydrophone that may be able to measure a flow rate of fluid flow, or a differential pressure gage positioned across the system 25 to detect a flow rate through the system 25.

Figure 3:
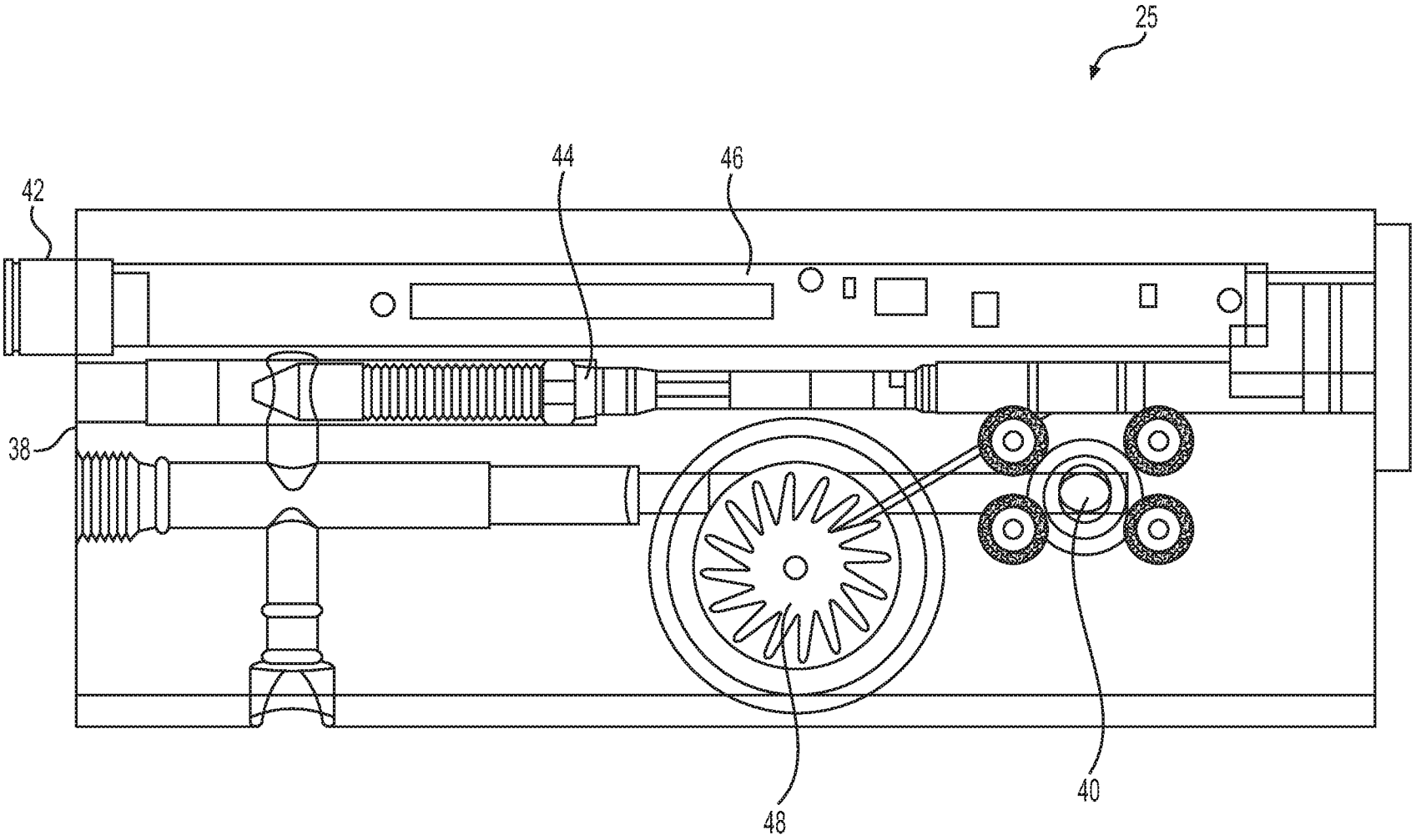
FIG. 3 shows a detailed view of a variable flow resistance system in accordance with one or more embodiments of the present disclosure.

Additionally or alternatively, the power generator 48 may be used as the flow rate sensor. For example, FIG. 3 shows a detailed view of a variable flow resistance system 25 in accordance with one or more embodiments of the present disclosure. The variable flow resistance system 25 in FIG. 3 may be an alternative embodiment to the variable flow resistance system 25 in FIG. 2, in which like features have like reference numbers. As shown in FIG. 3, the power generator 48 may include a turbine or rotor that rotates at a rate directly related or proportional to the fluid flow rate through the power generator 48. The turbine or rotor may, thus, be used to measure the flow rate of fluid through the system 25. In another embodiment, the power generator 48 may include a vortex generator that vibrates at a rate directly related or proportional to the fluid flow rate through the power generator 48. The power generator 48 may thus be used in addition or in alternative to a flow rate sensor to measure fluid flow rate through the system 25.

A table is provided below of simulated results for a well through a zone when choking or restricting the flow rate at the surface of the well. This table is only an example, as the present disclosure is not limited to only the flow rates, pressures, and ranges used within the table. As shown, a 10% change or reduction in the flow rate at the surface produces only a relatively small change in downhole pressure (5 psi (34 kPa) pressure change) in a tubular string. This small of a pressure change is difficult to measure without sensitive equipment (e.g., a power intensive pressure transducer), and may also be lost in noise or leaks along the tubular string. However, a 10% change or reduction in the flow rate at the surface still results in a 10% change or reduction in flow rate at the zone with the variable flow resistance system 25, within an error range of only 1%. This relationship between the change in flow rate at the surface and the change in flow rate at a particular flow resistance system is more predictable and easier to measure, as opposed to measuring changes in pressure at a particular flow resistance system.

| Surface Flow Rate (barrels per day) | Pressure (toe/heel) (pressure per square inch) | Zonal Flow Rate |
|---|---|---|
| Fully Open: 8000 bpd | 2811 psi/2799 psi | 100% |
| 10% Reduction: 7200 bpd | 2816 psi/2806 psi | 90% |
| 50% Reduction: 4000 bpd | 2832 psi/2829 psi | 50% |

Furthermore, though only one sensor and one actuator are shown in FIG. 2, the present disclosure is not so limited, as more than one sensor and/or more than one actuator may be used in accordance with the present disclosure. In such an embodiment, if using multiple sensors or actuators, the sensors and actuators used may be different from each other and/or may have different thresholds or tolerances than each other. For example, multiple different sensors may be used to measure different ranges of fluid flow rate through the system 25 or be used redundantly with respect to each other, and multiple different actuators may be used to control the inflow rate of the fluid using different techniques or at different thresholds.

The variable flow resistance system 25 may further include a controller and corresponding electronics 46 to control and manage the operation of the components of the system 25. In one embodiment, the controller may be in communication with or coupled to the flow rate sensor and the actuator 44 to control the actuator 44 based upon the measured flow rate and/or measured fluctuations of flow rate. The controller may be used to receive the measured flow rates and compare the measured flow rates and fluctuations with a predetermined value. Based upon the comparison of the measured flow rates with that of the predetermined value, the controller may then move the actuator 44 to adjust the inflow rate of fluid received into the first flow path 38 of the system 25 appropriately.

As an example, in one or more embodiments, the controller may receive the flow rate fluctuations measured by the sensor 42 and/or the power generator 48. The controller may then compare the measured flow rate fluctuations with one or more predetermined patterns for the flow rate fluctuations of the fluid to determine if a control signal has been included within the measured flow rate fluctuations. If, based upon the comparison, a control signal has been received through the measured flow rate or flow rate fluctuations, the controller may be used to adjust the actuator 44 appropriately, such as to increase or decrease fluid flow through the system 25. A control signal may indicate not only what position to move the actuator 44 to control the flow rate into the system 25, but the control signal may also indicate when to move or adjust the position of the actuator 44. The control signal may be used to indicate that the wellbore is in a preliminary phase or a "startup mode," in an intermediate phase, or in a final phase or a "late production mode," in which different control parameters may be used for each of these different phases of the well.

While control signals may be received by the system 25, such as through measuring the flow rate of fluid received by the system 25 discussed above, one or more signals may also be sent from the system 25 to other systems or receivers. For example, by controlling fluid flow rate from a transmitter upstream, the system 25 may receive a control signal. Accordingly, the system 25 may also control the fluid flow rate such that other systems or receivers downstream, either further downhole, uphole, or even close to the surface, depending on the direction of fluid flow, may receive a signal from the system 25. A signal may be sent to report properties measured by the system 25 and/or characteristics of the system 25 (e.g., fluid inflow rate into the system 25). Further, a signal may be used to confirm that the system 25 is working properly and/or confirm downhole conditions of the well. The controller may, thus, use flow rate telemetry to not only receive a control signal, but may also use flow rate telemetry to control the actuator 44 as desired to send a signal through the flow rate of the fluid. Alternatively, the system 25 may be capable of using other types of telemetry besides flow rate telemetry, such as mud-pulse telemetry, pressure profile telemetry, acoustic pulse telemetry, and/or pseudo-static pressure profile telemetry.

As shown and discussed above, an actuator may be used with a controller to selectively adjust, enable, and restrict fluid flow to perform as a fluid flow rate controller. In one or more embodiments, a fluid flow rate controller may be positioned in series or in parallel with a power generator within a variable flow resistance system. Accordingly, FIGS.

4-8 show different schematic arrangements for the fluid flow through a variable flow resistance system with a fluid flow rate controller 400 and a power generator 402 positioned in series or in parallel within the system.

Figure 4:
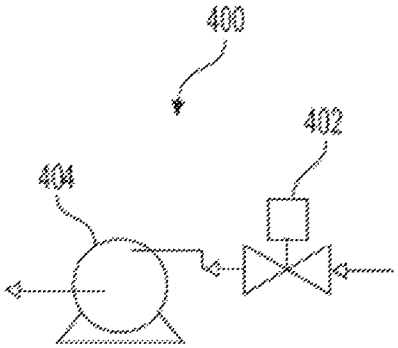
FIG. 4 shows a schematic view of a variable flow resistance system in accordance with one or more embodiments of the present disclosure.

In FIG. 4, a schematic view is shown of a variable flow resistance system 400 with the fluid flow rate controller 402 and the power generator 404 positioned in series within the system 400. This arrangement of the system 400 is similar to the system 25 shown in the embodiment of FIG. 2. In FIG. 4, the flow path is arranged such that fluid flows through the fluid flow rate controller 402 and then the power generator 404, as indicated by the directional arrows. Fluid may also flow in the reverse direction such that fluid flows through the power generator 404 and then the fluid flow rate controller 402.

Figure 5:
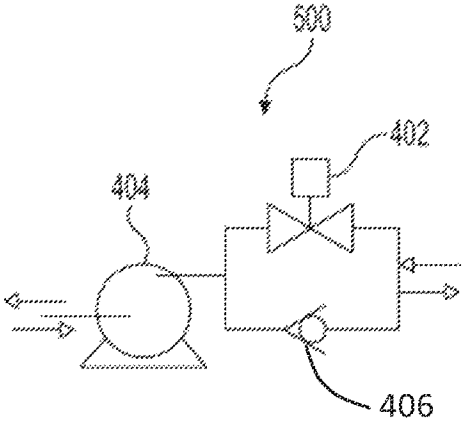
FIG. 5 shows a schematic view of a variable flow resistance system in accordance with one or more embodiments of the present disclosure.

In FIG. 5, a schematic view is shown of a variable flow resistance system 500 with the fluid flow rate controller 402 and the power generator 404 still positioned in series within the system 500. In this embodiment, a check valve 406 is included within the system 500 and is positioned in parallel with the fluid flow rate controller 402. This embodiment enables the fluid flow rate controller 402 to control the fluid flow rate through the system 500 in one direction, while the power generator 404 is able to generate power from fluid flow in both directions through the system 500. In another embodiment, the check valve 406 may be additionally or alternatively be positioned in parallel with the power generator 404.

Figure 6:
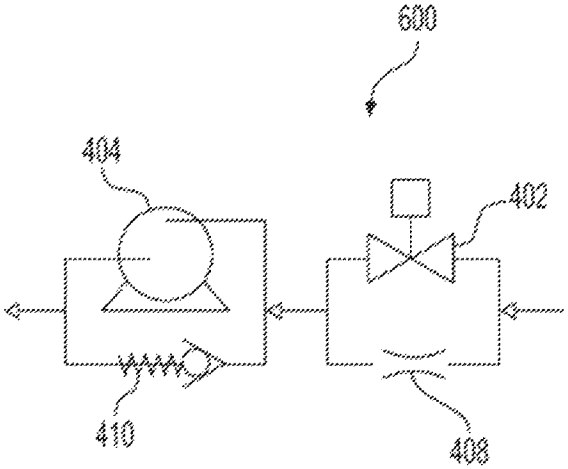
FIG. 6 shows a schematic view of a variable flow resistance system in accordance with one or more embodiments of the present disclosure.

In FIG. 6, a schematic view is shown of a variable flow resistance system 600 with the fluid flow rate controller 402 and the power generator 404 positioned in series within the system 600. In this embodiment, a nozzle 408 and/or a relief valve 410 may be included within the system 600. As shown, the nozzle 408 may be positioned in parallel with the fluid flow rate controller 402, and the relief valve 410 may be positioned in parallel with the power generator 404. The nozzle 408 is used in this embodiment to restrict but allow minimum fluid flow around the fluid flow rate controller 402. This arrangement enables fluid to still flow to the power generator 404 to generate power, even in a scenario when the fluid flow rate controller 402 is completely closed and preventing fluid flow therethrough. Further, the relief valve 410 may be used to relieve fluid pressure above a predetermined amount around the power generator 404.

Figure 7:
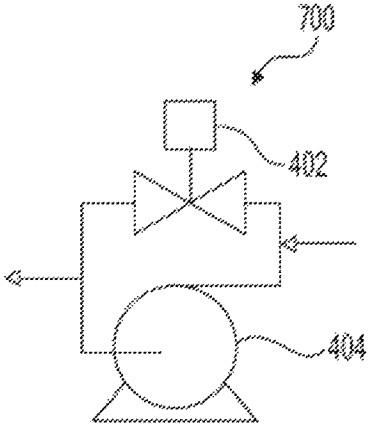
FIG. 7 shows a schematic view of a variable flow resistance system in accordance with one or more embodiments of the present disclosure.

In FIG. 7, a schematic view is shown of a variable flow resistance system 700 with the fluid flow rate controller 402 and the power generator 404 positioned in parallel within the system 700. In this embodiment, the flow path is arranged such that fluid flows separately to the fluid flow rate controller 402 and the power generator 404. As such, fluid may flow to the power generator 404 to generate power, even when the fluid flow rate controller 402 is completely closed and preventing fluid flow therethrough.

Figure 8:
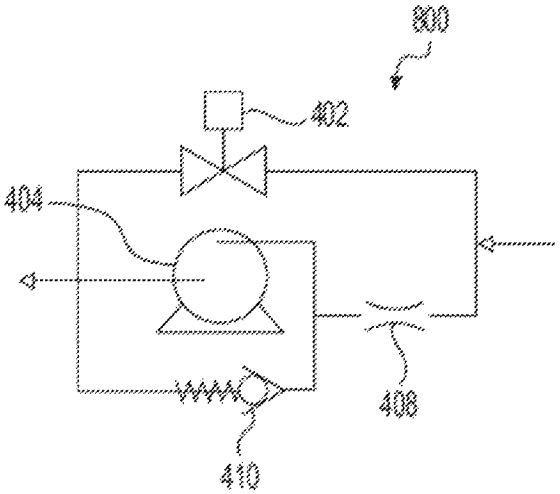
FIG. 8 shows a schematic view of a variable flow resistance system in accordance with one or more embodiments of the present disclosure.

In FIG. 8, a schematic view is shown of a variable flow resistance system 800 with the fluid flow rate controller 402 and the power generator 404 positioned in parallel within the system 600. A nozzle 408 and a relief valve 410 are also included within the system 600. The nozzle 408 is positioned in parallel with the fluid flow rate controller 402 to restrict the amount of fluid flow to the power generator 404. Further, the relief valve 410 is positioned in parallel with the power generator 404 to bypass the power generator 404 when fluid pressure is above a predetermined amount.

Figure 9:
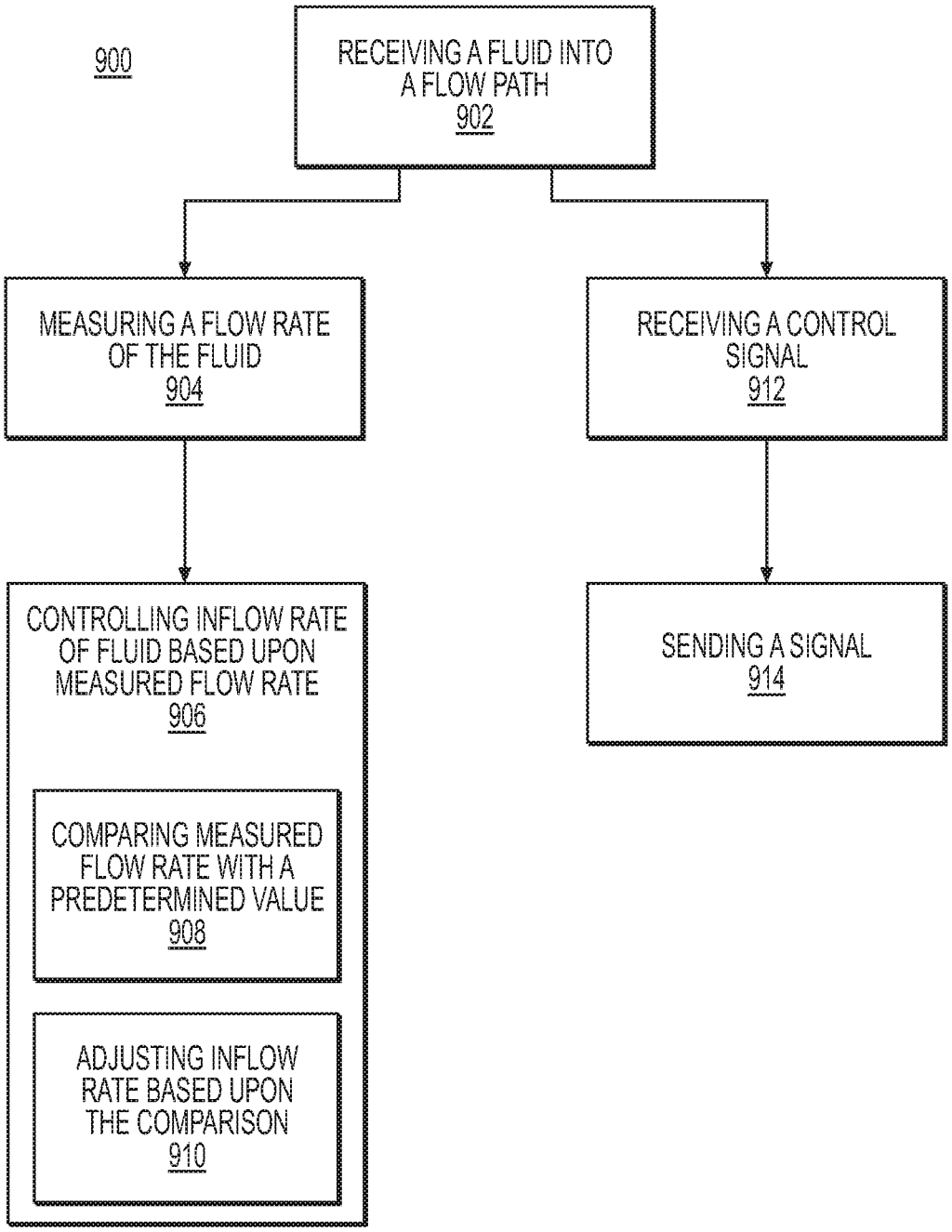
FIG. 9 shows a flowchart of a method of variably controlling flow resistance in a well.

Referring now to FIG. 9, a flowchart of a method 900 of variably controlling flow resistance or flow rate in a well in accordance with one or more embodiments of the present disclosure is shown. The method 900 includes receiving a fluid into a flow path 902, such as by receiving fluid into the first flow path of a variable flow resistance device, tool, or system. The method 900 may follow with measuring a flow rate or flow rate fluctuations received into the flow path 904, such as measuring with a sensor or power generator of the variable flow resistance system. The method 900 may further include controlling an inflow rate of the fluid received into the flow path based upon the measured flow rate of the fluid 906, such as controlling with the actuator of the variable flow resistance system.

The controlling of the inflow rate of the fluid 906 may include comparing the measured flow rate or flow rate fluctuations of the fluid with a predetermined value 908. For example, the measured flow rate fluctuations may be compared with one or more predetermined patterns or profiles for flow rate fluctuations of the fluid. If the measured flow rate fluctuations match or are similar to a predetermined pattern for the flow rate fluctuations of the fluid, this comparison may indicate that a control signal has been received by the variable flow resistance system. The controlling the inflow rate of the fluid 906 may then further include adjusting the inflow rate of the fluid received into the first flow path based upon the comparison of the measured flow rate or flow rate fluctuations of the fluid with the predetermined value 910. In particular, in the example above, as the comparison of the measured flow rate with the predetermined value indicated that a control signal was received by the variable flow resistance system, the inflow fluid restriction through the variable flow resistance system may be adjusted in accordance with the direction or instructions of the control signal. Adjusting the inflow rate of the fluid may result in a variation in the inflow fluid restriction, a variation in the pressure drop across the system, or a variation in both the fluid restriction and pressure drop.

The method 900 may also include receiving a control signal at a variable flow resistance device, tool, or system 912, such as similar as described with respect to steps 906, 908, and 910, after the receiving the fluid into the first flow path 902. The method 900 may then further include sending a signal from the variable flow resistance system 914. For example, the variable flow resistance system may use flow rate telemetry to send a signal to a component or receiver downstream, such as described with respect to steps 906, 908, and 910, or may use other types of telemetry, such as mud-pulse telemetry, pressure profile telemetry, acoustic pulse telemetry, and/or pseudo-static pressure profile telemetry.

Modifications, additions, or omissions may be made to method 900 without departing from the scope of the present disclosure. For example, the order of the steps may be performed in a different manner than that described and some steps may be performed at the same time. Additionally, each individual step may include additional steps without departing from the scope of the present disclosure.

Example 1

A variable flow resistance system for use with a subterranean well, the system comprising:

a first flow path to receive a fluid a flow rate sensor to measure a flow rate of the fluid received into the first flow path; and an actuator to control an inflow rate of the fluid received into the first flow path based upon the measured flow rate of the fluid.

Example 2

The variable flow resistance system of Example 1, wherein the flow rate sensor measures flow rate fluctuations of the fluid received into the first flow path, the system further comprising:

a receiver comprising the flow rate sensor to receive a control signal through the measured flow rate fluctuations of the fluid;

wherein the actuator controls the inflow rate of the fluid received into the first flow path based upon the control signal received by the receiver.

Example 3

The variable flow resistance system of any of the above Examples, further comprising:

a transmitter to transmit the control signal by generating the flow rate fluctuations of the fluid.

Example 4

The variable flow resistance system of any of the above Examples, wherein the transmitter is coupled to a choke, a valve, or a pump to generate the flow rate fluctuations of the fluid.

Example 5

The variable flow resistance system of any of the above Examples, further comprising a controller configured to control the actuator based upon the measured flow rate of the fluid, wherein the actuator adjusts the inflow rate of the fluid received into the first flow path.

Example 6

The variable flow resistance system of any of the above Examples, further comprising a power source to provide power to the variable flow resistance system.

Example 7

The variable flow resistance system of any of the above Examples, wherein the power source comprises a power storage device to provide stored power for the variable flow resistance system.

Example 8

The variable flow resistance system of any of the above Examples, wherein the power source comprises a power generator to generate power for the variable flow resistance system.

Example 9

The variable flow resistance system of any of the above Examples, wherein the power generator comprises a turbine to generate power solely from fluid received into the first flow path.

Example 10

The variable flow resistance system of any of the above Examples, wherein the flow rate sensor comprises the power generator such that the power generator measures the flow rate of the fluid received into the first flow path.

Example 11

The variable flow resistance system of any of the above Examples, wherein the actuator and the power generator are positioned in series or in parallel within the first flow path with respect to each other.

Example 12

The variable flow resistance system of any of the above Examples, wherein the flow rate sensor comprises a flow meter.

Example 13

The variable flow resistance system of any of the above Examples, further comprising a tool body and a second flow path configured to send the fluid into an interior or exterior of the tool body.

Example 14

The variable flow resistance system of any of the above Examples, further comprising a production tubing string, wherein the first flow path comprises a production orifice for the production tubing string.

Example 15

The variable flow resistance system of any of the above Examples, wherein the actuator comprises at least one of a screw assembly, a piezoelectric actuator, a hydraulic cylinder, an electric motor, and a hydraulic pump.

Example 16

A variable flow resistance system for use with a subterranean well, the system comprising:

a first flow path to receive a fluid;

a receiver to receive a control signal through flow rate fluctuations of the fluid received into the first flow path; and an actuator to control an inflow rate of the fluid received into the first flow path based upon the control signal received by the receiver.

Example 17

The variable flow resistance system of any of the above Examples, wherein the receiver comprises a flow rate sensor to measure the flow rate fluctuations of the fluid received into the first flow path, the system further comprising:

a transmitter to transmit the control signal by generating the flow rate fluctuations of the fluid.

Example 18

The variable flow resistance system of any of the above Examples, wherein the actuator adjusts the inflow rate of the fluid received into the first flow path to generate second flow rate fluctuations of the fluid, further comprising:

a second receiver downstream of the actuator to receive a second control signal through the second flow rate fluctuations of the fluid.

Example 19

A method of variably controlling flow resistance in a well, the method comprising:
receiving a fluid into a first flow path;
measuring a flow rate of the fluid received into the first flow path; and
adjusting an inflow rate of the fluid received into the first flow path based upon the measured flow rate of the fluid.

Example 20

The method of any of the above Examples, wherein the adjusting the inflow rate comprises:
comparing the measured flow rate of the fluid with a predetermined value; and adjusting the inflow rate of the fluid received into the first flow path based upon the comparison of the measured flow rate of the fluid with the predetermined value.

Example 21

The method of any of the above Examples, wherein the measuring the flow rate comprises measuring flow rate fluctuations of the fluid, and wherein the adjusting the inflow rate comprises:
comparing the measured flow rate fluctuations of the fluid with a predetermined pattern for the flow rate fluctuations of the fluid;
adjusting the inflow rate of the fluid received into the first flow path based upon the comparison of the measured flow rate fluctuations of the fluid with the predetermined pattern for the flow rate fluctuations of the fluid.

Example 22

The method of any of the above Examples, wherein:
the measuring the flow rate comprises receiving a control signal through flow rate fluctuations of the fluid; and
the adjusting the inflow rate comprises adjusting the inflow rate of the fluid received into the first flow path based upon the control signal.

Example 24

The method of any of the above Examples, further comprising generating the flow rate fluctuations of the fluid to transmit the control signal.

Example 25

The method of any of the above Examples, further comprising generating power from the fluid received into the first flow path.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A variable flow resistance system for use with a subterranean well, the system comprising:
an inlet to receive a fluid, the inlet in fluid communication with a first flow path;
a receiver comprising a flow rate sensor to measure flow rate fluctuations of the fluid received into the first flow path, the receiver to receive a control signal through a predetermined pattern of flow rate fluctuations in the measured flow rate fluctuations of the fluid; and
an actuator to control an inflow rate of the fluid received into the first flow path based upon the control signal received by the receiver;
a power generator to generate power for the variable flow resistance system; and
a bypass flow path configured to allow an amount of the fluid sufficient to operate the power generator to bypass the actuator.

2. The variable flow resistance system of claim 1, further comprising: a transmitter to transmit the control signal by generating the flow rate fluctuations of the fluid.

3. The variable flow resistance system of claim 2, wherein the transmitter is coupled to a choke, a valve, or a pump to generate the flow rate fluctuations of the fluid.

4. The variable flow resistance system of claim 1, further comprising a controller configured to control the actuator based upon the measured flow rate of the fluid, wherein the actuator adjusts the inflow rate of the fluid received into the first flow path.

5. The variable flow resistance system of claim 1, further comprising a power storage device to provide stored power for the variable flow resistance system.

6. The variable flow resistance system of claim 1, wherein the power generator comprises a turbine to generate power solely from fluid received into the first flow path.

7. The variable flow resistance system of claim 1, wherein the flow rate sensor comprises the power generator such that the power generator measures the flow rate of the fluid received into the first flow path.

8. The variable flow resistance system of claim 1, wherein the actuator and the power generator are positioned in series or in parallel within the first flow path with respect to each other.

9. The variable flow resistance system of claim 1, wherein the flow rate sensor comprises a flow meter.

10. The variable flow resistance system of claim 1, further comprising a tool body and a second flow path configured to send the fluid into an interior or exterior of the tool body.

11. The variable flow resistance system of claim 1, further comprising a production tubing string, wherein the first flow path comprises a production orifice for the production tubing string.

12. The variable flow resistance system of claim 1, wherein the actuator comprises at least one of a screw assembly, a piezoelectric actuator, a hydraulic cylinder, an electric motor, and a hydraulic pump.

13. A variable flow resistance system for use with a subterranean well, the system comprising:
an inlet to receive a fluid, the inlet in fluid communication with a first flow path;
a receiver to receive a control signal through a predetermined pattern of flow rate fluctuations of the fluid received into the first flow path;
an actuator to control an inflow rate of the fluid received into the first flow path based upon the control signal received by the receiver;
a power generator to generate power for the variable flow resistance system; and a bypass flow path configured to allow an amount of the fluid sufficient to operate the power generator to bypass the actuator.

14. The variable flow resistance system of claim 13, wherein the receiver comprises a flow rate sensor to measure the flow rate fluctuations of the fluid received into the first flow path, the system further comprising: a transmitter to transmit the control signal by generating the flow rate fluctuations of the fluid.

15. The variable flow resistance system of claim 13, wherein the actuator adjusts the inflow rate of the fluid received into the first flow path to generate second flow rate fluctuations of the fluid, further comprising: a second receiver downstream of the actuator to receive a second control signal through the second flow rate fluctuations of the fluid.

16. A method of variably controlling flow resistance in a well, the method comprising:

receiving a fluid into a first flow path of a variable flow resistance system;

measuring flow rate fluctuations of the fluid received into the first flow path;

generating power via a power generator of the variable flow resistance system in fluid communication with a bypass flow path of the variable flow resistance system, the bypass flow path configured to allow an amount of the fluid sufficient to operate the power generator to bypass an actuator of the variable flow resistance system;

receiving a control signal through a predetermined pattern of flowrate fluctuations in the measured flow rate fluctuations of the fluid; and adjusting an inflow rate of the fluid received into the first flow path based upon the control signal.

17. The method of claim 16, further comprising generating the flow rate fluctuations of the fluid to transmit the control signal.

* * * * *